US008096453B2

(12) United States Patent
Lowe et al.

(10) Patent No.: US 8,096,453 B2
(45) **Date of Patent: *Jan. 17, 2012**

(54) GUN HOLSTER

(75) Inventors: Michael V. Lowe, Boise, ID (US); Anthony J. Senn, Boise, ID (US); Ron Avery, Olathe, CO (US)

(73) Assignee: Tactical Design Labs, Boise, ID (US)

( * ) Notice: Subject to any disclaimer, the term of this patent is extended or adjusted under 35 U.S.C. 154(b) by 0 days.

This patent is subject to a terminal disclaimer.

(21) Appl. No.: 11/466,199

(22) Filed: Aug. 22, 2006

(65) Prior Publication Data

US 2007/0194067 A1 Aug. 23, 2007

Related U.S. Application Data

(60) Division of application No. 10/886,006, filed on Jul. 6, 2004, now Pat. No. 7,140,523, which is a continuation of application No. 09/816,764, filed on Mar. 23, 2001, now Pat. No. 6,886,725.

(51) Int. Cl.
*F41C 33/02* (2006.01)

(52) U.S. Cl. ..... 224/244; 224/243; 224/911

(58) Field of Classification Search ..... 224/192, 224/193, 196, 198, 238, 243, 244, 911, 912, 224/242, 245, 217; 211/64
See application file for complete search history.

(56) References Cited

U.S. PATENT DOCUMENTS

| | | | | | |
|---|---|---|---|---|---|
| 1,113,530 | A * | 10/1914 | Audley | 224/244 |
| 1,641,439 | A * | 9/1927 | Jovino | 224/244 |
| 1,842,936 | A * | 1/1932 | Franz | 224/243 |
| 1,951,865 | A * | 3/1934 | Ferdinand Franz | 224/244 |
| 2,349,376 | A * | 5/1944 | Ray | 224/244 |
| 2,551,913 | A * | 5/1951 | Toby | 224/244 |
| 3,420,420 | A * | 1/1969 | Clark | 224/243 |
| 4,277,007 | A * | 7/1981 | Bianchi et al. | 224/193 |
| 4,846,384 | A * | 7/1989 | Perry | 224/244 |
| 4,912,867 | A * | 4/1990 | Dukes, Jr. | 42/70.11 |
| 4,934,574 | A * | 6/1990 | Salandre | 224/244 |
| 5,048,735 | A * | 9/1991 | McCormick | 224/244 |
| 5,215,238 | A * | 6/1993 | Baruch | 224/243 |
| 5,419,474 | A * | 5/1995 | Marx et al. | 224/244 |
| 5,518,155 | A * | 5/1996 | Gallagher | 224/244 |
| 5,855,305 | A * | 1/1999 | Nichols | 224/244 |
| 5,918,784 | A * | 7/1999 | Serpa | 224/244 |
| 5,944,239 | A * | 8/1999 | Rogers et al. | 224/193 |
| 6,547,111 | B2 * | 4/2003 | French | 224/244 |
| 6,575,343 | B2 * | 6/2003 | Mossman | 224/198 |
| 6,769,581 | B2 * | 8/2004 | Rogers et al. | 224/243 |

* cited by examiner

*Primary Examiner* — Justin Larson
*Assistant Examiner* — Corey Skurdal
(74) *Attorney, Agent, or Firm* — Robert L. Shaver

(57) ABSTRACT

A security holster for use with a handgun. A locking device secures and engages various safety features of the handgun, and retains it in the holster until released by the user. The security holster provides for one handed insertion and withdrawal of a handgun, and prevents unauthorized removal of the handgun. An audible indication of insertion and locking is provided by the locking mechanism security holster.

10 Claims, 10 Drawing Sheets

GUN HOLSTER

PRIORITY

This application is a divisional of the utility patent application titled GUN HOLSTER filed by Lowe et al. on Jul. 6, 2004, with application Ser. No. 10/886,006, which is a continuation of the utility patent application titled GUN HOLSTER filed by Lowe et al. on Mar. 23, 2001 with application Ser. No. 09/816,764, the disclosures of which are incorporated herein.

DESCRIPTION

Background of the Invention

1. Field of the Invention

The present invention generally relates to handgun holsters, and more particularly relates to holsters that provide security against unauthorized withdrawal of a handgun.

2. Background Information

Police officers, security officers, and military personnel in a number of situations must be ready to withdraw and use a handgun in the line of duty at a moments notice. In an emergency situation, withdrawing the handgun must be done in a completely natural and unobstructed manner to increase the draw speed. The officer's life may depend on the speed with which he/she can withdraw the handgun. However, after the handgun is withdrawn, the situation may dictate other options or needs, requiring the officer to re-holster the handgun just as quickly. Current holsters do not meet this demand without some continued manipulation of security straps before the officer knows or has confidence that the weapon is secure. In this type of situation, the officer needs to be able to holster his/her handgun with one hand without looking at the holster and while maintaining eye contact with the suspect. During holstering, an audible click, tactile sensation or other affirmative sound or indication such as a beep, whistle, light emitting diode or vibration indicating that the handgun is secured in the holster, would be preferable.

The problem results when a suspect becomes an assailant, and attacks the officer and tries to gain access to his weapon. When this situation develops, it is of utmost importance that the officer maintains control of his/her handgun while simultaneously preventing the assailant access to the handgun. Many holsters have been designed to accomplish this purpose in a number of different manners. However, they all suffer a number of drawbacks. Some require two hands to release and secure the handgun. This is unacceptable. Some of them secure the handgun with a device, which can be difficult to release in a fast draw situation and therefore is a dangerous security mechanism. Some holsters secure the weapon in place from bouncing out of the holster, but are not designed to withstand the attack of an assailant, and would allow the gun to be taken from the officer by an assailant. Some holsters use electronic devices for fingerprint recognition and run the risk of malfunctioning or having a dead battery. Some holsters require the user to tilt or rock the handgun, or twist it before it can be released from the handgun. Such a maneuver must be practiced frequently in order to ensure that the wearer can perform it without mistake in an emergency situation. All of these methods of securing a handgun are problematic, and an improved security holster is needed which solves these problems.

For these reasons, it is an object of the invention to provide a security holster for a handgun which allows a handgun to be quickly inserted or withdrawn with one hand without looking at the holster, and which secures the holster to the officer without undue manipulation of straps or the handgun. It is a further goal of the invention that the security holster not allows an assailant to withdraw the handgun against the will of the officer. It is a further object of the invention to provide a handgun-securing holster that is easily released by a natural and fluid motion of the officer. It is a further object of the invention to provide a security holster that has an audible click, sound, vibration or visual affirmation that indicates to the user that the handgun is secured in the holster. Another object of the invention is to provide a security holster with a mechanism that allows the holster to withstand severe force without releasing the handgun until the releasing mechanism is activated. Another object of the invention is to require a minimum compression force that must be exerted on the security holster in order to engage and disengage the locking mechanism for a handgun.

SUMMARY OF THE INVENTION

These and other objects of the invention are accomplished by the security holster of the invention. The security holster is designed to be used with a handgun, and to be mounted on a user's belt, concealed carry harness or other mounting positions. The holster has an inner and outer side wall, which together define an interior cavity into which the handgun is placed. There is an open top portion of the holster, which is designed to receive the handgun, and from which the handgun is removed.

The security holster includes a locking means that is designed to engage a feature of the handgun with an audible indication alerting the user that the handgun has been locked in place. A tactile and or visual indicator is also possible. The locking means interacts with a handgun feature when the handgun is placed in the inner cavity of the security holster. The features with which the locking means can interact can include the ejection port of a semi-automatic pistol, the trigger guard of a revolver or semi-automatic handgun, the back of the slide of a semi-automatic pistol or other features, depending on the specific handgun for which the security holster is fitted. The locking means engages the handgun feature in order to prevent the withdrawal of the handgun without releasing the locking means.

The device also includes a releasing means, which is positioned adjacent to the trigger and trigger guard of the handgun. This releasing means is designed so that the user may activate and thereby release the locking means by flexure of the user's finger, such as an index finger. By basing the release of the locking means on flexure of the user's finger, the design is made difficult to circumvent by an assailant reaching into the holster with his/her finger and releasing the locking means. By requiring flexure of the user's finger to release the locking means, it is almost impossible for an assailant attacking from the front to reach in and release the handgun.

The device also includes a finger tube built into the side wall of the holster into which the user inserts a finger for activating the release means. Thus, the finger tube acts as a release tab protector. It serves the purpose not only of protecting the release tab from access by an assailant, but also protects the release tab from being accidentally depressed when an officer might be brushing against a building or rolling on the ground. The security holster is configured for one-handed insertion of a handgun. When the handgun is fully inserted and the locking means is engaged, the user is notified of this by an audible sound or click upon locking. In another preferred embodiment, the handgun may alert the user that the handgun is in the locked or unlocked position.

When the locking tab is fully engaged in the ejection port, the security holster may emit a beep or activate a whistle, bell, light emitting diode (LED) or vibrator. Such an alert or indication would allow a user to know that the handgun is or is not secured and locked into position. Such knowledge might be invaluable depending on the specific circumstances of a security holster user. The handgun is retained until the locking mechanism is released by the releasing device, which is activated by the user depressing the releasing means by flexure of a finger, usually the index finger.

In one embodiment of the invention, the locking means is a generally rectangular block that engages the ejection port of a semi-automatic pistol. The locking means in this embodiment is a locking tab, which is attached to a metal plate that is itself attached to the holster. The metal plate is hinged, with the plate on one side of the hinge being rigidly attached to the holster, and the plate on the other side of the hinge being free to rotate back and forth. The hinged plate is referred to as the spring assembly. The part of the spring assembly mounted to the holster body is called the fixed plate. Attached to the fixed plate is a first arm on which the locking tab is mounted. The locking tab is configured to allow the unobstructed entry of the handgun into the holster to press against the slide of a handgun as the handgun is inserted into the holster, and to drop into place in the ejection port of a handgun when the handgun is fully inserted into the holster. To accomplish this, the locking tab has a sloping face that faces the open end of the holster and allows entry and passage of the handgun. The locking tab has a notch in the side, which faces the open end of the holster, which locks against an edge of the holster at a locking tab passage that extends through the holster body. A rebounding element requires that the handgun be pushed into the security holster with a minimum compression force thereby allowing the locking tab to drop into position in the ejection port. That same compression force is necessarily exerted against the handgun before the locking tab can be released.

A second arm of the spring plate assembly is attached to the first arm. The second arm includes a release tab, which is directly and operationally connected to the first arm and the locking tab. The release tab is configured to rest adjacent the trigger guard of the handgun when the handgun is fully inserted into the holster. The release tab also covers the trigger so that depressing the release tab does not activate the trigger. This feature prevents the handgun from being accidentally fired when it is in the security holster. Activation of the release tab is accomplished by the user flexing a finger, generally an index finger, when it is inserted into the holster adjacent the release tab.

The security holster of the invention thus provides for one-handed insertion of the handgun. During insertion of the handgun into the security holster, the locking tab admits the handgun and engages a feature of the handgun for retention of the handgun unless and until the locking tab is disengaged by the user pressing the release tab. The release tab is pressed by the natural flexure of the user's finger. In this way, the handgun can be removed from the security holster without looking at it, and by the user using only one hand. Features which can be added to enhance the embodiment of the security holster described above can include the locking tab being configured to make an audible click or affirmation when it engages with the handgun feature. The affirmation may be the activation of a beep, bell, whistle, vibrator or light emitting diode. The handgun feature can be the ejection port, a trigger guard, the back of the handle or any other appropriate feature of the handgun.

The spring plate assembly of the invention can take several different forms. In one embodiment of the security holster, the spring plate assembly includes a piano hinge between the fixed plate and the first and second arm. This connection is essentially a lever that is hingedly connected. The hinge runs parallel to a long axis of the security holster. In this embodiment, the hinge between the fix plate and the first and second arm includes a biasing device such as a spring.

In another version of the security holster, the spring plate assembly includes a torsion spring, which connects the fixed plate with the first and second arm. One feature of the holster of the invention can include the holster being made of a rigid material such as a sturdy plastic. Other materials could also be suitable such as leather or metal, or combinations of these materials. The locking tab can be configured so that the edge of the locking tab which faces toward the open end of the holster is sloping, which enables the handgun to slide under it upon insertion. The side of the locking tab which faces toward the barrel end of the holster is also notched, so that when the locking tab drops into the handgun feature such as the ejection port, the notch will engage the handgun feature and prevent the handgun from being withdrawn from the security holster past the locking tab.

One embodiment of the security holster includes a locking tab which is connected to the spring plate assembly by a floating connection, which allows the locking tab a certain limited freedom of motion in it's attachment to the spring plate assembly. This floating attachment allows force applied to the handgun to withdraw it to be transferred through the locking tab to the security holster. In this way, the security holster is much stronger in resisting this unauthorized withdrawal of a handgun than if the force of the withdrawal were applied to the spring plate assembly alone, through the spring plate assembly's connection to the locking tab.

Another embodiment of the security holster utilizes one or more springs which are biased upon insertion of a handgun. In some embodiments, the handgun must be inserted biasing the spring to a minimum locking compression before the locking tab is engaged. After the handgun is fully inserted and then released, the springs press the handgun toward the entry end of the handgun thereby engaging the locking notch of the locking tab against the holster body at the locking tab passage. In this configuration, to release and remove the handgun, the user first presses the handgun deeper into the security holster a small amount, then depresses the release tab.

One embodiment of the invention utilizes the finger tube in which the access of the finger tube is generally parallel to the long axis of the holster body. It encloses and covers the release tab, and may require the insertion of one third or more of a user's finger. The finger tube of the security holster can also be referred to as a finger receiving receptacle and it may be designed to allow a finger of the user to be inserted within it. The finger tube or finger-receiving receptacle thus protects the release tab from access or from accidental release.

One version of the security holster of the invention is configured so that the release tab and the locking tab are connected to each other by what amounts to a lever. The fulcrum of the lever is located between the locking tab and the release tab, and pressing on the release tab causes the locking tab to move in the opposite direction as the direction of pressure is applied to the release tab. This makes the lever a first class lever, which is defined as a lever in which the fulcrum is between the force and the load. The security holster has a long axis, which parallels the barrel of a handgun, which is inserted into it. One version of the security holster utilizes a lever that is positioned normal to the long axis of the security holster. The torsion spring may be utilized at the fulcrum of the lever, to press the locking tab towards the handgun. The locking tab of the handgun, which utilizes a first class lever as a release mechanism, can interact with features of the handgun such as the ejection port or the trigger guard.

A desirable feature of the security holster is the use of a rebounding device within the security holster. The rebounding device contacts the handgun as it is being inserted into the holster, and resists pressing the handgun into the holster. The handgun is pressed against the rebounding device for a sufficient distance and pressure, and when the required distance and force are applied, the locking tab engages the handgun feature. When the handgun is released, the rebounding device presses the handgun against the locking tab. The required insertion distance and insertion force can be adjusted on the security holster. In some situations, a low insertion force and/or distance may be desirable, and in other situations, a higher insertion force and distance may be preferred. These are accomplished by a force adjustment mechanism and a distance adjustment mechanism on the security holster.

The invention also includes a method for releasing a handgun from a security holster, which includes the step of; placing a user's hand on a handgun seated in the security holster with the user's finger over a release tab which is located adjacent to a trigger guard of the handgun. The next step is to push the handgun into the security holster a predetermined distance against a rebounding device in the security holster. The next step is for the user to flex their finger against the handgun release tab while that handgun is pressed against the rebounding device. Once the release tab is depressed, the next step is to remove the handgun from the security holster by continuing to depress the release tab momentarily while pulling straight back on the handgun handle so that the handgun is withdrawn from the security holster in a straight line. Other holsters are available as prior art, which require the withdrawal of the handgun to take an angled or compoundly angled path when exiting the security holster. These devices prove problematic in use, because in an emergency situation, the user forgets to utilize the angled, twisted or compound angled withdrawal path. Holsters with such a withdrawal method are dangerous for the officer, and become so secure that the user may be killed.

An alternative method for releasing a handgun from the security holster of the invention includes the steps of inserting a finger into the finger tube of the security holster, pushing the handgun into the security holster a predetermined distance against the rebounding device, the user flexing the finger inserted into the finger tube against the handgun release tab while the handgun is pressed against the rebounding device, and removing the handgun from the security holster while depressing the release tab. Each of these methods can be modified by the additional step of adjusting an insertion distance adjustment mechanism on the rebound device, which changes the required insertion distance that must be accomplished by the handgun against the rebounding device. An additional step to the above procedures can include adjusting an insertion force adjustment mechanism for changing the necessary insertion force that must be exerted by the handgun against the rebounding device. This allows a user to adjust the required insertion force between a maximum and a minimum allowed by the force adjustment mechanism. Another optional step in the methods listed above includes the step of actuating the release tab by flexing the users finger in a direction substantially normal to a plane of the security holster, which bisects the handgun barrel and the handgun handle.

The invention also includes a method of inserting a handgun into a security holster, which includes the steps of inserting the handgun into the security holster until resistance from a rebounding device is met, and pressing the handgun further against the rebounding device until a minimum insertion depression distance is met, at which point a locking tab of the security holster engages a feature of the handgun for locking engagement of the handgun. This method can further include the step of providing an auditory signal generating mechanism on the security holster for confirming that the handgun is secured in the security holster. The auditory signal can comprise a bell, beep, vibrator, clicker or other sound generating device.

Another method involved with the invention is a method of removing a holstered and secured handgun from a security holster. This includes the steps of placing a user's hand around a handgun handle when the handgun is holstered and secured in a security holster. The next step is placing a user's finger over the trigger guard area of the handgun, which is adjacent to a release tab of the security holster. The next step is pressing the handgun deeper into the security holster against the rebounding device until a minimum depression distance is achieved. At that point, the next step is depressing the release tab on the security holster by flexing the forefinger against the release tab, which is located over the trigger guard area of the handgun. This depression of the release tab disengages a locking tab from the feature of the handgun, thus allowing removal of the handgun. The next step is to hold the release tab down momentarily while removing the handgun from the holster in a straight line.

Still other objects and advantages of the present invention will become readily apparent to those skilled in this art from the following detailed description wherein we have shown and described only the preferred embodiment of the invention, simply by way of illustration of the best mode contemplated by carrying out my invention. As will be realized, the invention is capable of modification in various obvious respects all without departing from the invention. Accordingly, the drawings and description of the preferred embodiment are to be regarded as illustrative in nature, and not as restrictive.

DESCRIPTION OF THE PREFERRED EMBODIMENTS

Figure 1A:
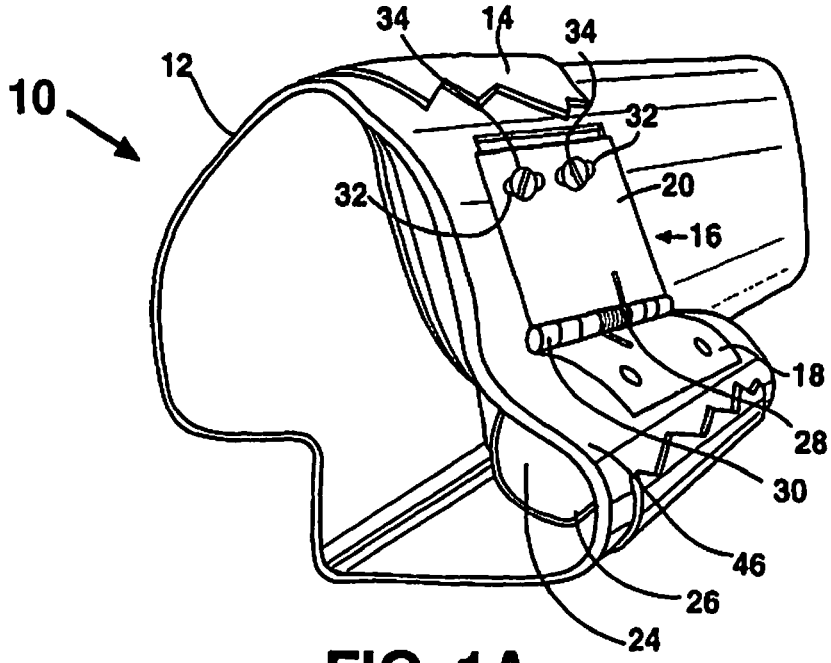
FIG. 1A is a perspective cutaway view of the security holster.
Figure 1B:
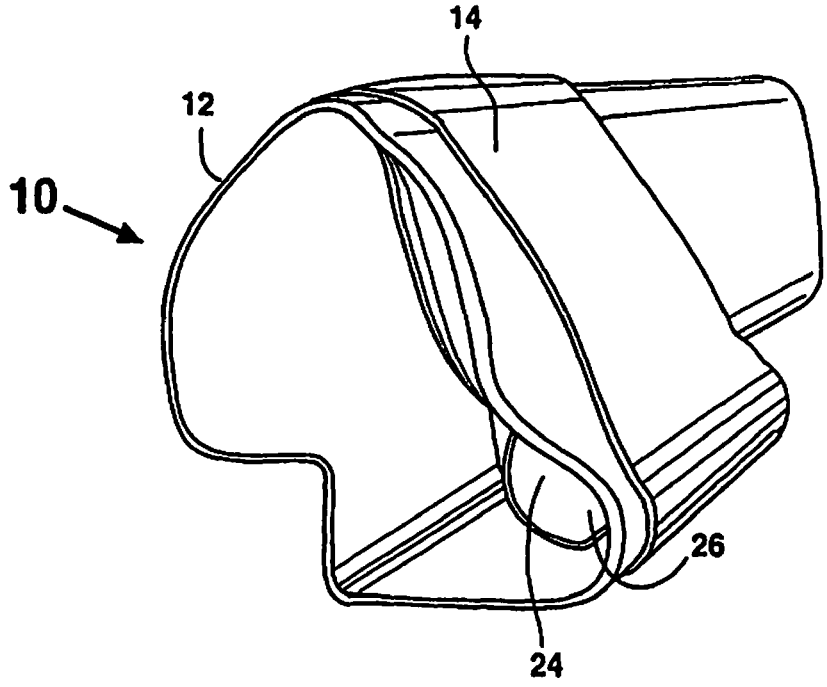
FIG. 1B is a perspective view of the security holster.

While the invention is susceptible to various modifications and alternative constructions, certain illustrated embodiments thereof have been shown in the drawings and will be described below in detail. It should be understood, however, that there is no intention to limit the invention to the specific form disclosed, but, on the contrary, the invention is to cover all modifications, alternative constructions, and equivalents falling within the spirit and scope of the invention as defined in the claims.

Figure 2:
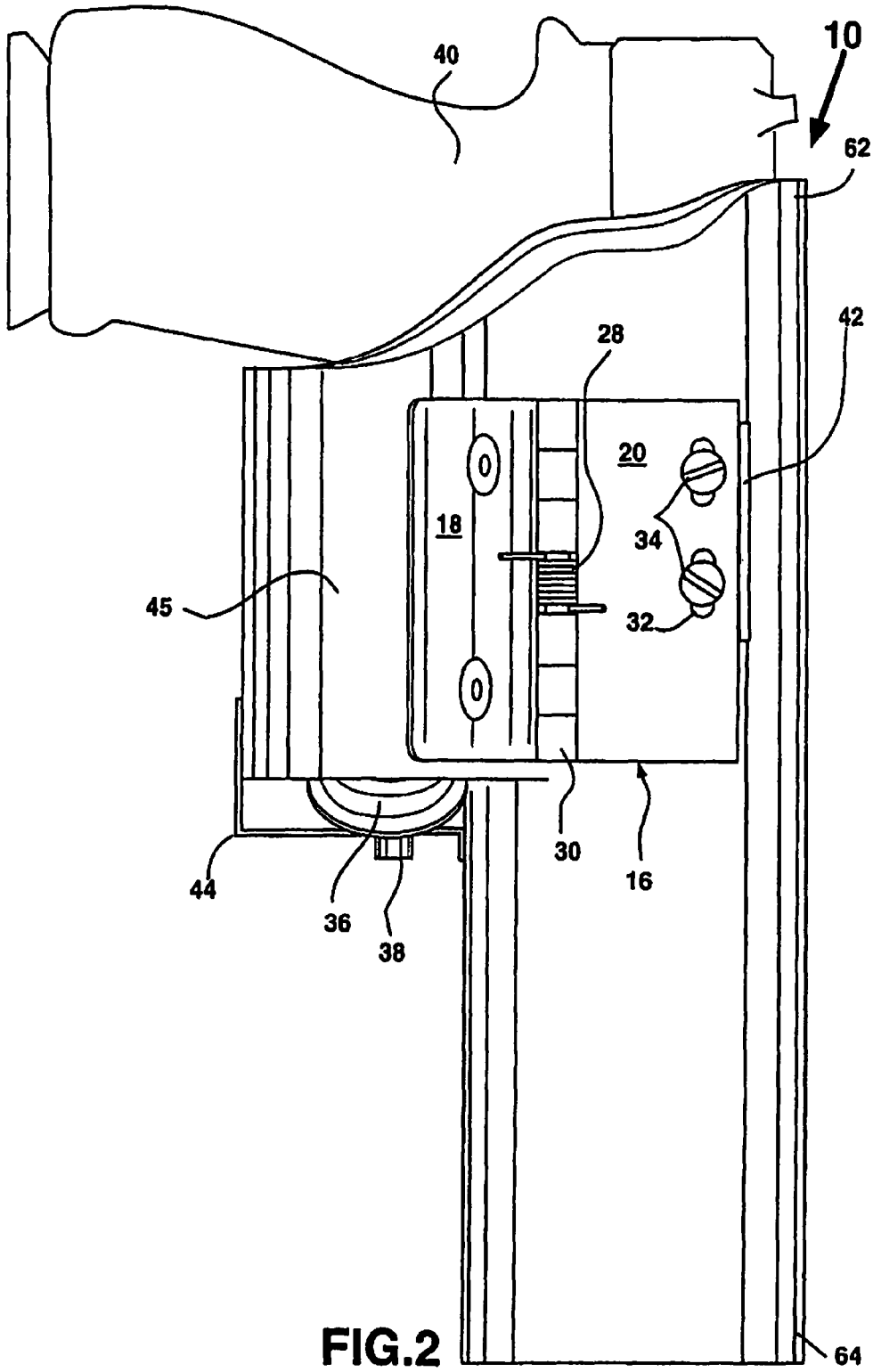
FIG. 2 is a side view of the security holster with a handgun inserted into the security holster.

Several preferred embodiments and features of the security holster are shown in FIGS. 1-10. Preferably, the security holster is made of a tough and durable plastic such as Kydex (manufactured by Kleerdex Company). A thickness of ⅛ inch of this material has been found to be suitable for making the security holster. Other materials or thicknesses of materials that have similar characteristics of rigidity, strength and weight would also be suitable. This might include metal such as aluminum or steel, other types of plastics or leather. The security holster shown in FIGS. 1A, 1B and FIG. 2 shows the general configuration of the security holster when used with a handgun 40, and is designated as 10 in the figures. The security holster 10 is not limited strictly to handguns. In additional embodiments, the security holster 10 may be adapted to holster additional devices such as stun guns, tools, or other instruments that could benefit from the features of the present invention. The security holster 10 includes a holster body 12 and a holster outer cover 14. The holster outer cover 14 wraps either fully or partially around the holster body 12, and covers the locking mechanism. FIG. 1A shows the holster outer cover 14 cut away to reveal the locking mechanism of this embodiment.

The locking mechanism of this embodiment is referred to as a spring plate assembly 16. The spring plate assembly 16 includes three parts. The first part is a fixed plate 18, which is rigidly and permanently attached to a bulge in the holster body 12. The bulge in the holster body 12 forms a finger tube 46, which is an opening or finger-receiving receptacle between the handgun and the holster body 12, which allows insertion of a user's index finger. The fixed plate 18 is preferably metal, and Stainless Steel has proven to be a suitable metal for its construction. Opposite the fixed plate 18 is a first arm 20, which is rigidly attached to a second arm 24, both of which are attached by a hinge 30 to the fixed plate 18. The second arm 24 includes a release tab 26, which is semicircular in cross section and fitted to receive the index finger of a user, and lies over the trigger and trigger guard of a handgun 40 when it is fully inserted into the security holster 10. The second arm 24 and its components are rigidly attached to the first arm 20. The first arm 20 also includes locking tab mounting slots 32, locking tab mounting screws 34, and a locking tab 22 (which is shown in FIG. 3B). The locking tab 22 is mounted to the first arm 20 so that the screws 34, which secure it, allow the locking tab 22 to move back and forth in the locking tab mounting slots 32. The first arm 20 and second arm 24 are attached to the fixed plate 18 by a hinge 30. The hinge 30 includes a spring 28, which presses the first arm 20 against the holster body 12. The spring 28 also pushes the second arm 24 away from the handgun and towards the finger tube 46. The locking tab 22 passes through a locking tab passage 42 in the holster body 12, in order to engage the ejection port of the handgun 40 and a portion of the holster body 12.

FIG. 1A also shows an insertion distance adjuster 72. By adjusting the insertion distance adjuster, the user can select for himself the distance that the handgun must be pressed in before the locking tab snaps into place. In this way the user can select very little distance, even zero, or can select the maximum insertion distance available. In the example of the insertion distance adjuster shown in FIG. 1A, the deeper that the adjustment screw 74 is inserted, the less insertion distance is required to clear the undercut on the locking tab 22.

FIG. 2 is a side view of the security holster of the invention showing the outer cover removed so that the locking mechanism is more visible. Shown in FIG. 2 is a trigger guard 76 of the handgun 40. Mounted to a spring bracket 44 is an adjustable travel stop 78. By moving the adjustable travel stop in or out in relation to the trigger guard 76, the distance that the handgun may be inserted into the holster is adjusted. The view shown in FIG. 2 can be modified so that the adjustable travel stop includes a spring or other biasing member, by adjusting the adjustable travel stop and its associated spring or biasing member, the amount of force required to engage the locking tab 22 with the handgun 40 can be adjusted by the user.

Figure 3A:
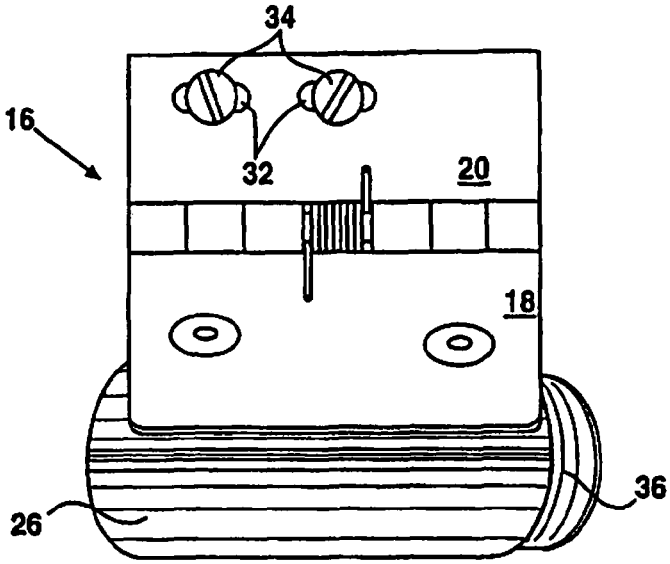
FIG. 3A is a side view of the right side of the spring plate assembly.
Figure 3B:
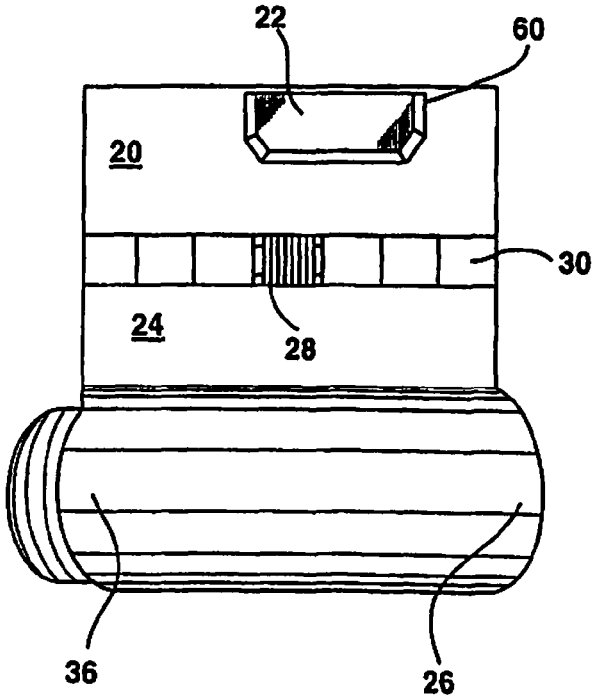
FIG. 3B is a side view showing the left side of the spring plate assembly.

FIGS. 3A and 3B show a detailed view of the spring plate assembly 16. These views are of the right and left side of the spring plate assembly 16, with the holster body 12 removed. As seen in FIG. 3A, the release tab 26 is semicircular in cross section to easily admit and receive a user's index finger. On one end of the release tab 26 is a fingertip flare 36, which is also curved and serves to help the user position his/her finger on the release tab 26. The release tab 26 may be engaged when a user flexes a finger in the direction of the release tab 26. In the preferred embodiment, release is accomplished by flexing the finger in a direction normal to the plane of the security holster and corresponding handgun. Flexing is defined as the bending of a portion of a finger about a joint that allows the finger to apply pressure against a surface or mechanism. A release tab 26 is positioned so that it can be released by a finger flexed in a single direction, which provides an additional safety feature. The tendons of a finger only allow a finger to be flexed in a direction toward the palm of the hand. As a result, an unauthorized person that is able to insert a finger in the finger tube of the security holster would probably not be able to easily release the gun by finger flexure. As shown in FIG. 3A, the locking tab mounting slots 32 allow the locking tab mounting screws 34 and the locking tab 22 to move back and forth in the locking tab mounting slots 32. As shown in FIG. 3B, the locking tab 22 has several angled faces which facilitates the locking tab 22 in engaging and disengaging from a handgun feature. An engagement edge 60 faces towards an entry end 62 of the security holster 10.

Figure 4A:
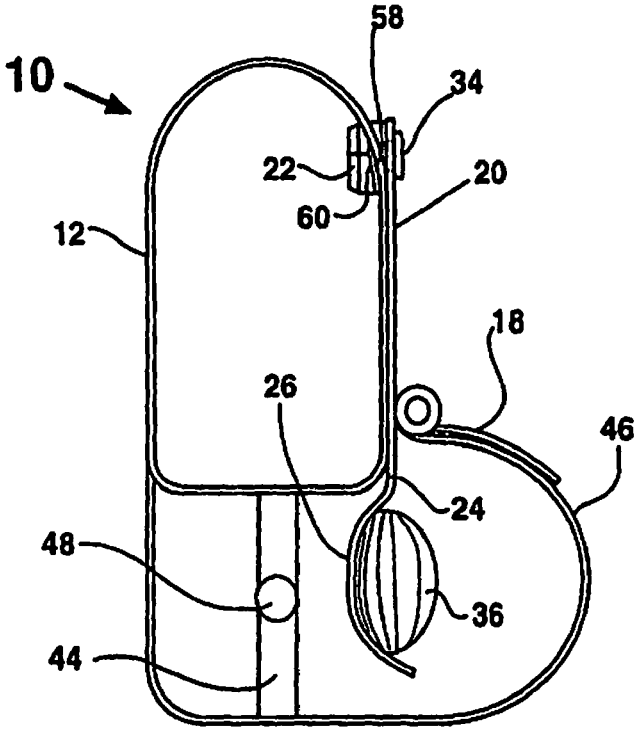
FIG. 4A is a rear view of the security holster showing the locking tab in the locked position.
Figure 4B:
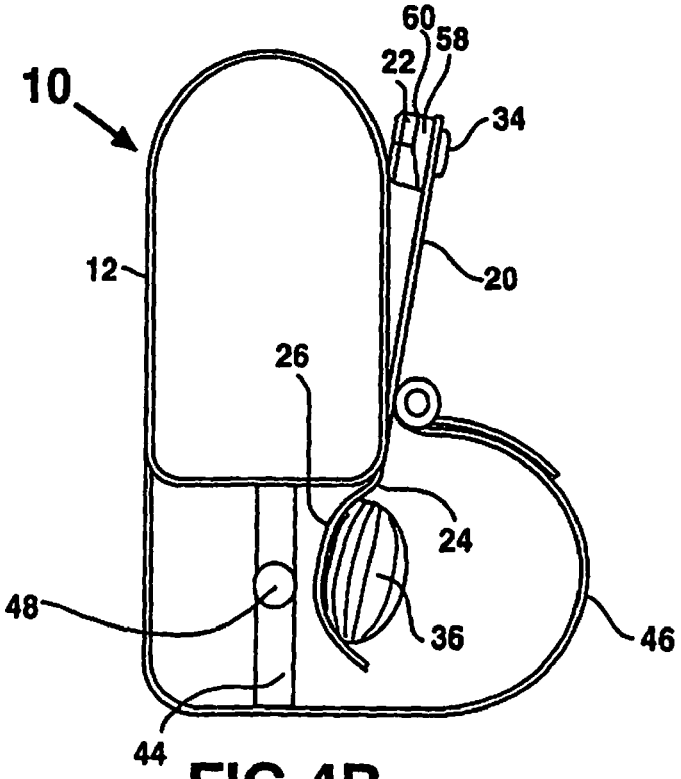
FIG. 4B is a rear view of the security holster showing the locking tab in a releasing position.

FIGS. 4A and 4B are views of the security holster 10 looking from the entry end 62 toward the barrel end 64. They show the spring plate assembly 16 in two positions. FIG. 4A shows the spring plate assembly with the first arm 20 lowered into a locking position. If a handgun 40 were in the security holster 10 in this position, the locking tab 22 would be engaged with the ejection port of the handgun to secure the handgun 40 in the security holster 10. Additionally, the angled faces slide under the security holster body 12 preventing the locking tab 22 from being improperly removed. FIG. 4B shows the first arm 20 raised away from the holster body 12 into a release position. When the fixed arm 20 moves in relation to the holster body 12, the second arm 24 also moves, since it is rigidly attached to the first arm 20. In this position, the locking tab 22 is disengaged from the ejection port of the handgun 40, and the handgun 40 could be withdrawn from the security holster 10. The first arm essentially functions as a first class lever. A first class lever is defined as a lever where the fulcrum is between the load and the effort force. In the present invention, the hinge 30 (the fulcrum) is between the locking tab 22 (the load) and the release tab 26 (effort force). The lever is oriented so that if the gun in the holster is oriented with the barrel horizontal, the lever arm of the security holster is oriented vertically, with the spring on the hinge oriented horizontally.

Figure 5:
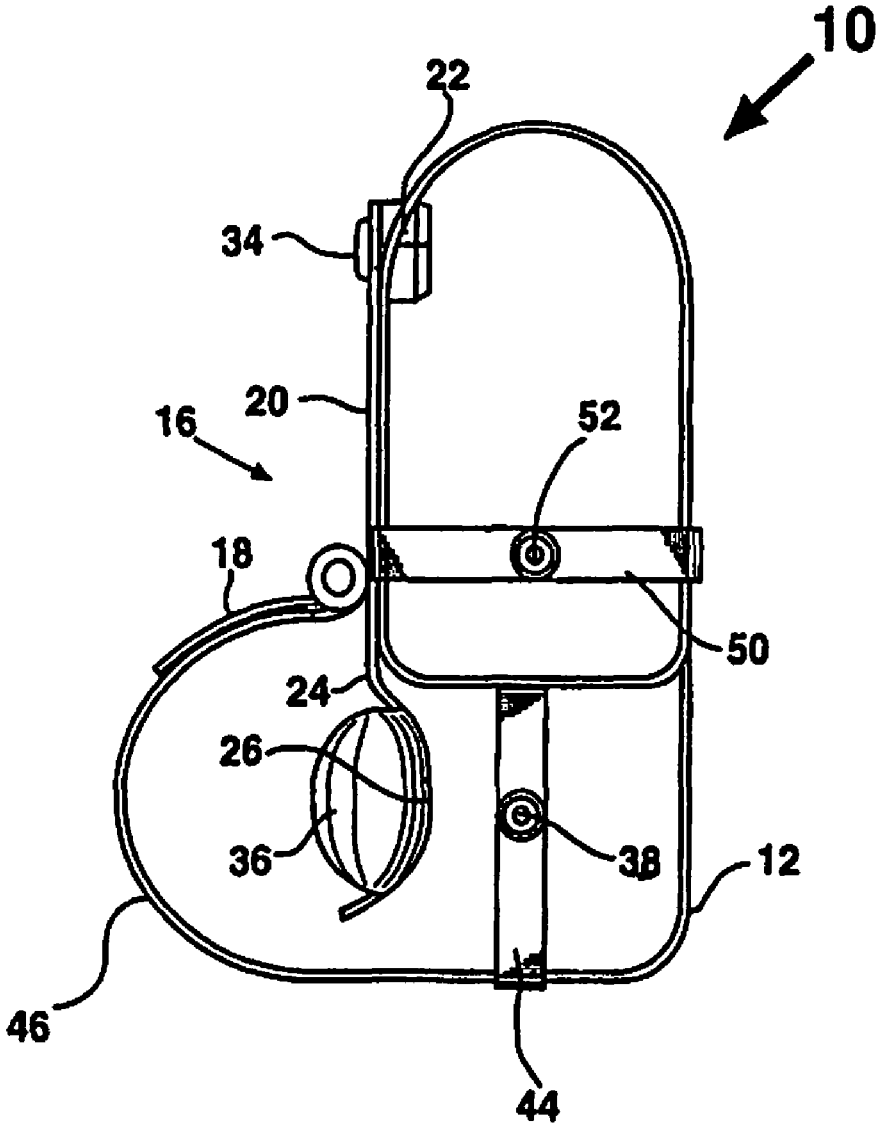
FIG. 5 is a front view of the security holster.

FIG. 5 is a front view of the security holster 10, looking from the barrel end 64 towards the entry end 62. This view shows a first arm 20 in a locking position. It also shows a trigger guard spring mount 38 and a slide spring mount 52. These are two alternative positions of a spring, which extends backward from the spring bracket 44 or the slide spring bracket 50, with a short coil spring, which presses against the handgun 40. In the preferred embodiment, this coil spring is approximately ¼ inch in diameter, and extends approximately ¾ inches toward the entry end 62 of the security holster 10. When a handgun 40 is inserted into the security holster 10, the spring is depressed until its length is about ⅜ inches. Two positions are shown for a spring bracket and a spring. The reason for this is that some handguns 40 can be equipped with devices such as flashlights or laser sights, which mount to the front of a trigger guard of a handgun. With such a device, the trigger guard spring bracket 44 would be dispensed with only the slide spring bracket 50, and the slide spring mount 52 would be utilized. These springs serve as a rebounding device or pressure switch. Other rebounding devices could also be utilized such as a compressible material such as foam, or an elastomer would serve as such a rebounding device. In additional embodiments, the rebounding device could be a piston or air bag. Use of the rebounding device may require a user to compress the rebounding device before the spring plate assembly 16 would engage to lock in the handgun. Additionally, when a user desires to remove the handgun from the holster, it is necessary to first compress the rebounding device before the release tab could be used to disengage the locking tab and corresponding angled faces. In a preferred embodiment, the rebounding device is adjustable. The rebounding device may allow a user to define a minimum distance and/or force that must be exerted against the rebounding device before the locking mechanism and corresponding locking tab can be engaged and/or disengaged. A user that has a need of quick accessibility to his handgun may dial down the minimum compression force that must be exerted against the handgun in order to activate and disengage the locking mechanism. In most circumstances the direction of the required rebounding force is parallel to the long axis of the security holster toward a bottommost portion of the security holster. In other circumstances, a user may want to adjust the rebounding device so that no force or distance requirement is needed to draw the handgun. An adjustment mechanism for the rebounding device may function by tightening or loosening the tension on a spring or other rebounding device as previously defined.

Figure 6A:
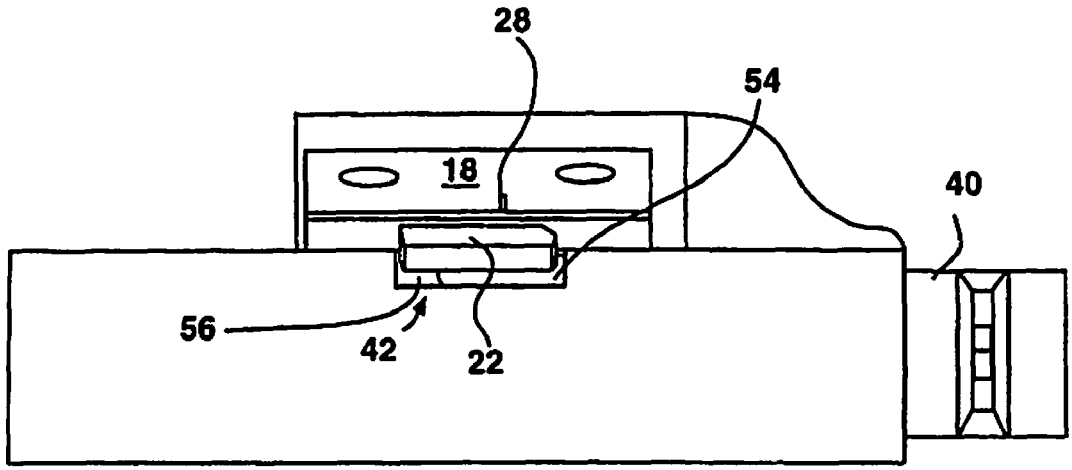
FIG. 6A is a top view of the security holster with a handgun partially inserted.
Figure 6B:
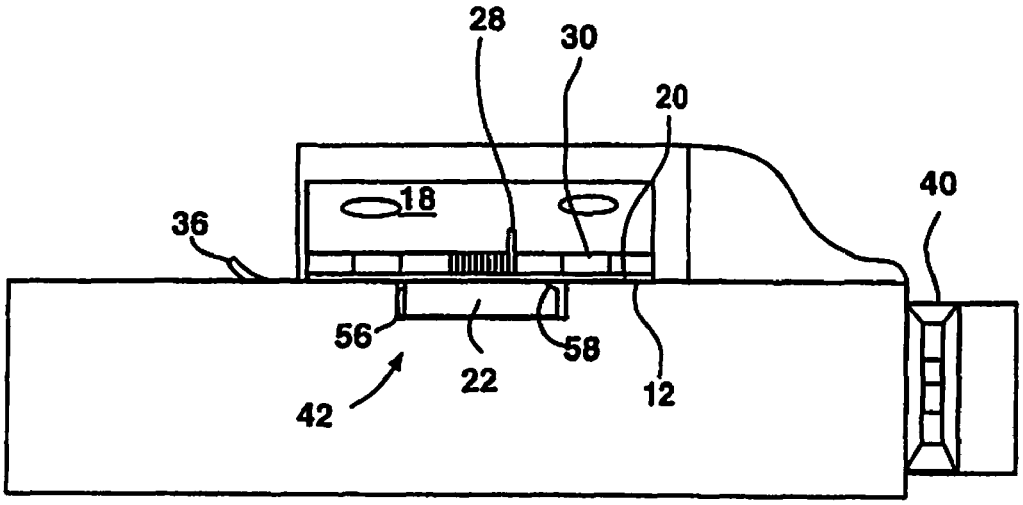
FIG. 6B is a top view of the security holster with a handgun fully inserted, but not released.
Figure 6C:
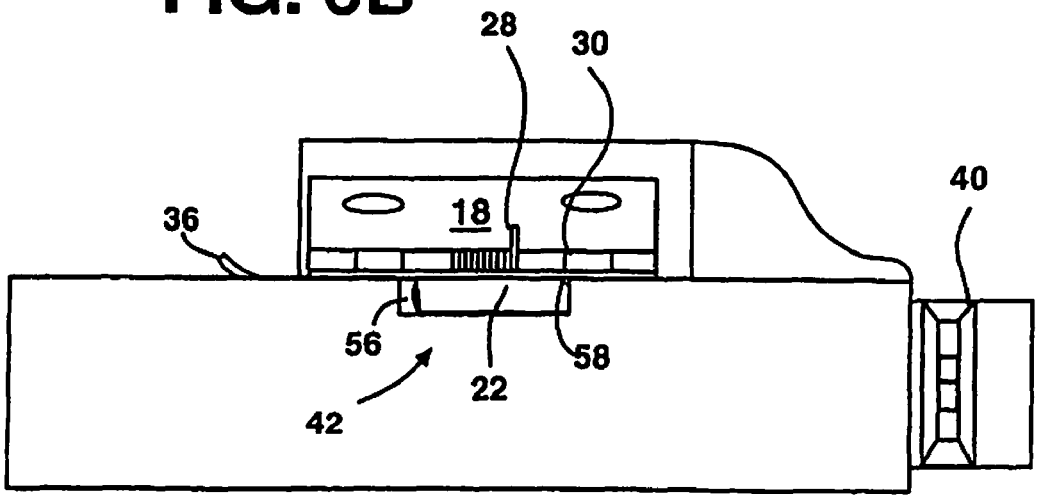
FIG. 6C is a top view of the security holster with a handgun fully inserted, not released, and locking tab is shown engaged with holster body.
Figure 8:
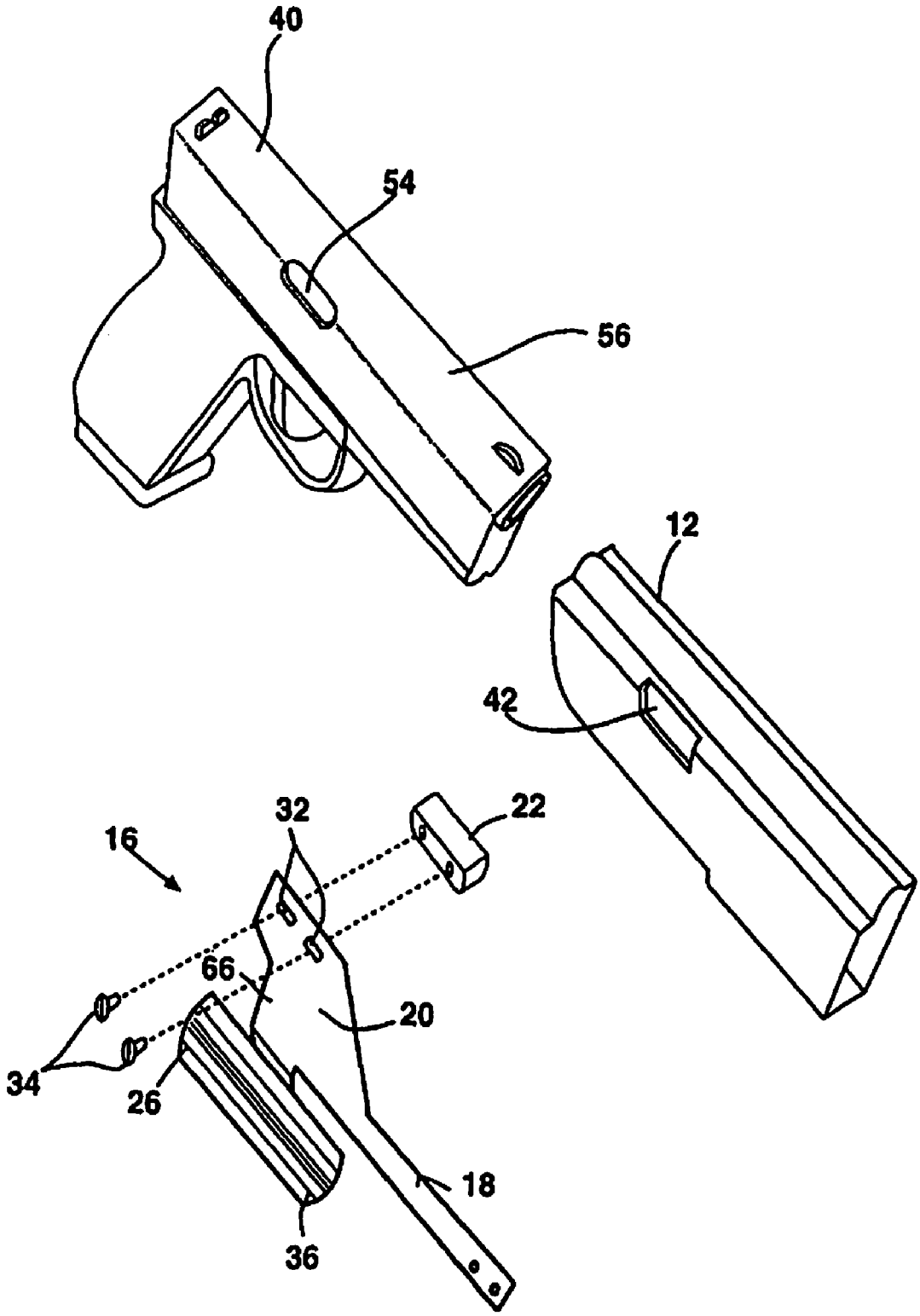
FIG. 8 is an exploded view of the security holster with torsion spring and its parts.

FIGS. 6A, 6B and 6C illustrate the interaction of the security holster 10, the locking tab 22, and the handgun ejection port 54 of the handgun 40. When seen from the top view, the security holster 10 has a locking tab passage 42, which is adjacent the locking tab 22 and allows the locking tab 22 to pass through the wall of the security body 12. The handgun 40 includes a handgun slide 56 and a handgun ejection port 54, which permits a spent cartridge (not shown) to pass through the handgun ejection port 54 and through the handgun slide 56. FIG. 8 shows these handgun parts to advantage. As a handgun 40 is inserted into the security holster 10, the handgun slide 56 lifts the locking tab 22, and slides past it as it enters the security holster 10. FIG. 6A shows a portion of the handgun slide 56 lifting the locking tab 22. The handgun ejection port 54 is visible in the locking tab passage 42 of the security holster 10.

As shown in FIG. 6B, when the handgun 40 has been fully inserted into the security holster 10, the locking tab 22 is past the handgun slide 56, and can drop into place in the handgun ejection port 54. When this happens, the first arm 20 falls into place against the side of the holster body 12 as shown in FIG. 6B. The locking tab 22 includes an engagement notch 58, which is adjacent the interface of the locking tab 22 and the first arm 20. At this point, the handgun 40 cannot be removed without first depressing the release tab 26. If the release tab 26 were depressed, the locking tab 22 would move into the position shown in FIG. 6A, and the handgun ejection port 54 would not be engaged, and the handgun 40 could be removed.

In one preferred embodiment of the security holster 10 of the invention, the security holster 10 is provided with one or more springs. A spring can be mounted on the trigger guard spring bracket 44, and/or could be mounted on the slide spring bracket 50, which was shown in FIG. 5. In the embodiment which utilizes one or more springs, once the handgun had been fully inserted as shown in FIG. 6B, the user could release the handgun 40 and the spring would press the handgun back in the security holster 10 until the engagement notch 58 of the locking tab 22 engaged with the holster body 12 which was exposed in the locking tab passage 42. This position is shown in FIG. 6C. When springs are used as described above, the user would need to compress the springs a small amount by pressing down on the handgun 40, in order to engage or release the locking tab 22 and thus the handgun by pressing the release tab 26. This creates a secondary locking system by physically linking the locking tab 22 to the holster body 12. When this happens, if force is applied to the handgun to withdraw it without first releasing the locking tab 22, the force is transmitted to the holster body, and the first arm 20 does not bear this force without support. When the handgun 40 is inserted into the security holster, a similar minimum biasing force must be exerted against the handgun 40 in order for the locking tab 22 to engage the ejection port.

Figure 7:
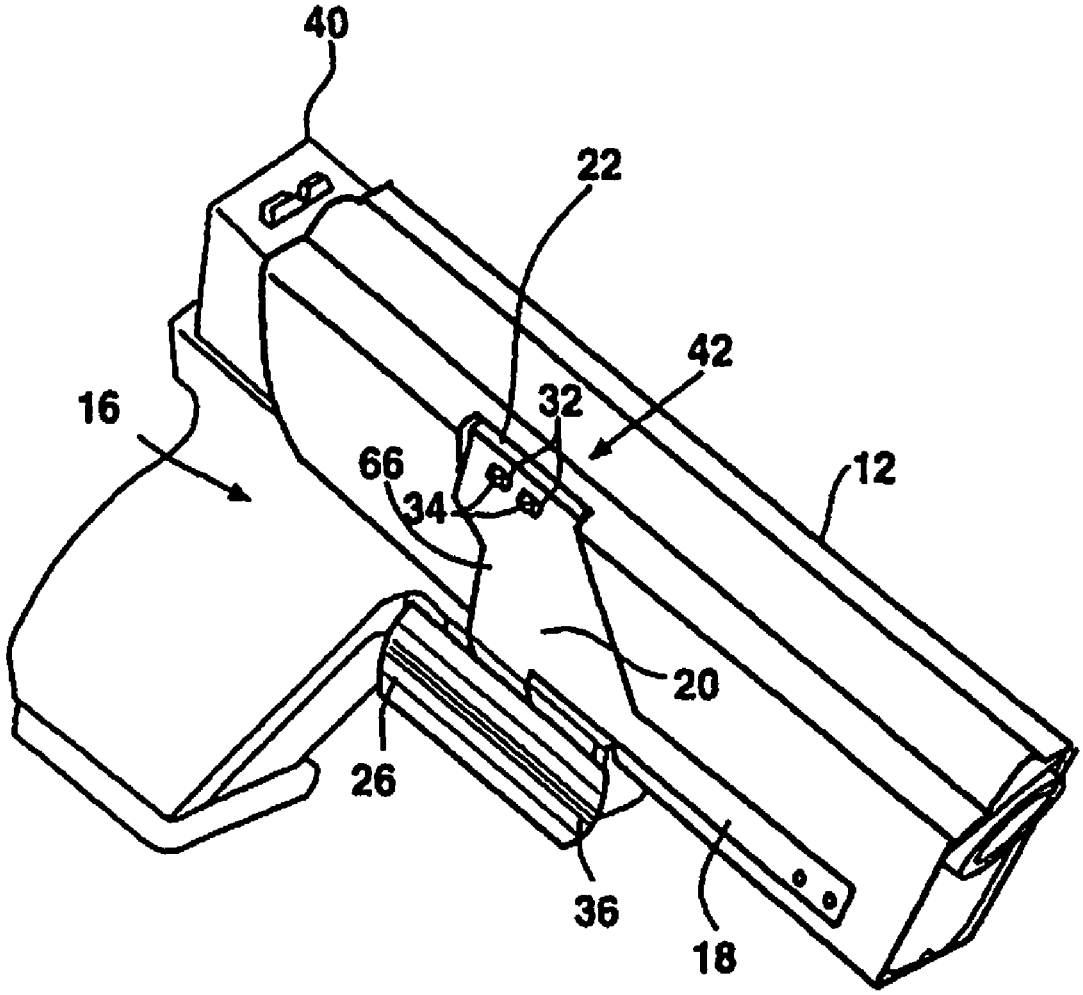
FIG. 7 is a perspective view of the security holster that utilizes a torsion spring.

A second preferred embodiment of the invention is shown in FIGS. 7 and 8, in which the spring plate assembly is a T-shaped torsion spring 66. Depressing a second arm 26 of the torsion spring 66 lifts the first arm 20 and its attached locking tab 22 out of the ejection port 54 of the handgun to release the handgun 40.

Figure 9:
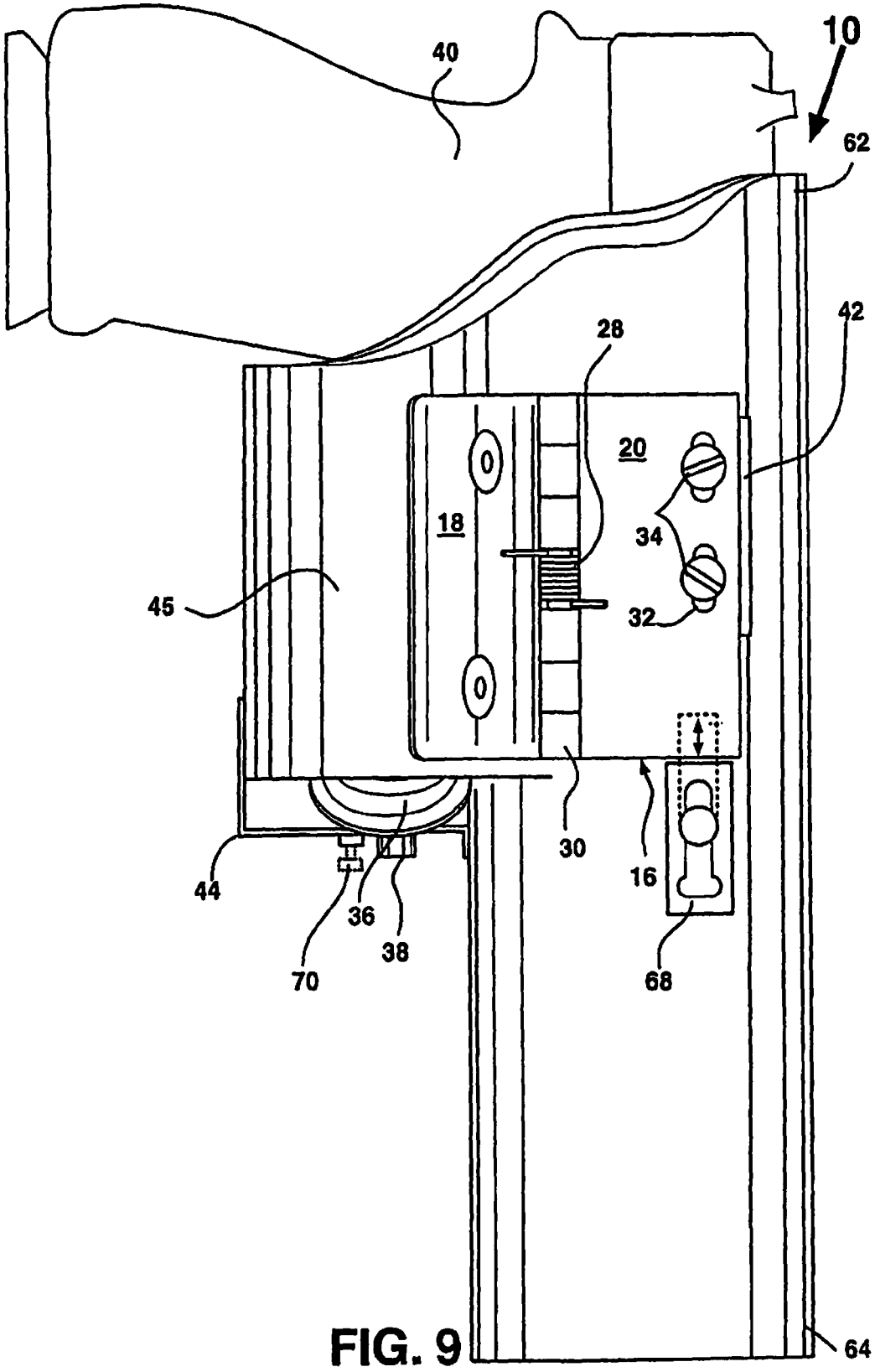
FIG. 9 is a side view of the handgun showing safety lock mechanisms.

FIG. 9 shows the security holster 10 of the invention with a first security lock 68 and a second security lock 70. Each of these security locks allow a user to lock the first and second arm from movement, and thus lock a handgun 40 in the security holster 10, and prevent the release of the locking tab 22. In either security lock, a tab can be moved forward or backward which physically prevents the locking tab 22 from being lifted, and thus prevents the handgun 40 from being released and withdrawn.

Figure 10A:
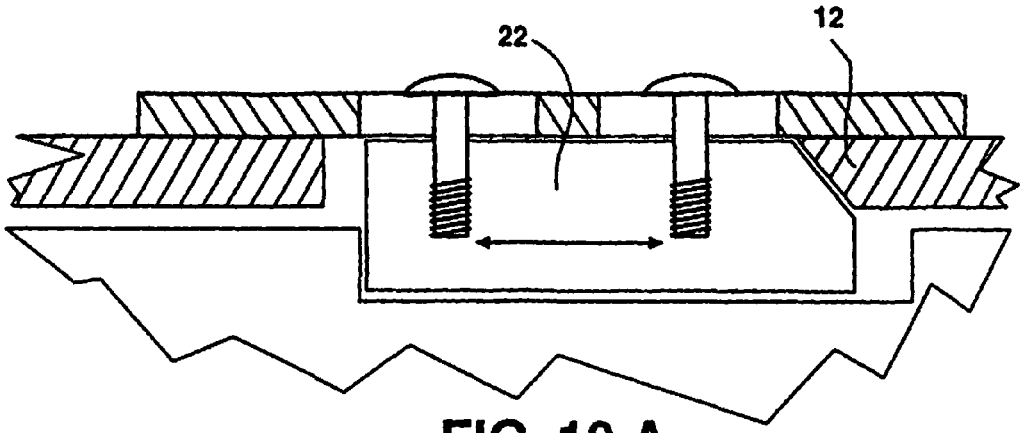
FIG. 10A is an embodiment of the locking tab with a tapered edge.
Figure 10B:
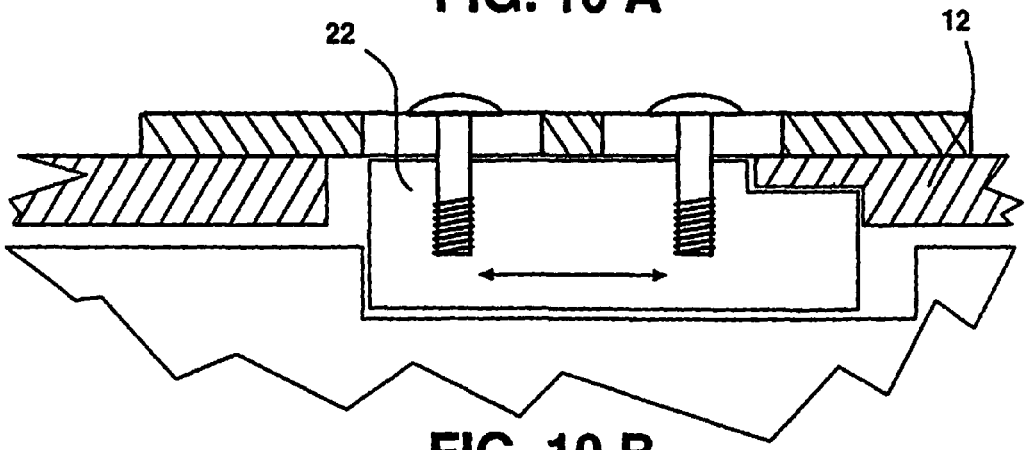
FIG. 10B is an embodiment of the locking tab with a lap joint configuration.
Figure 10C:
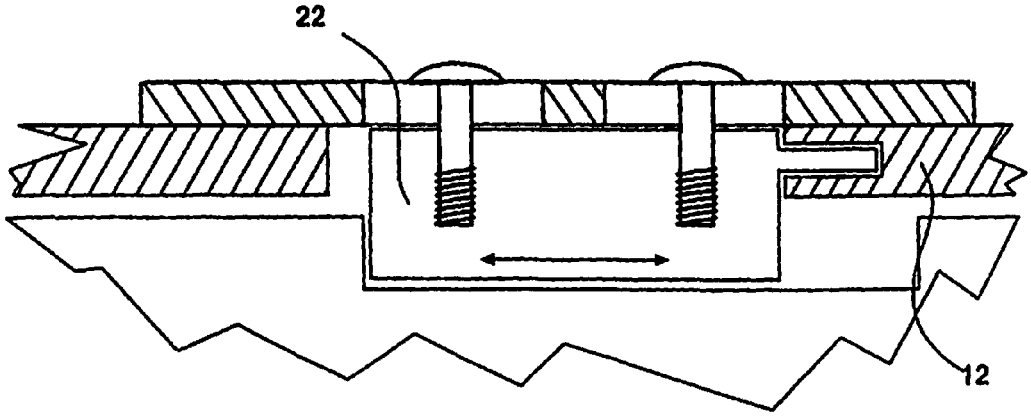
FIG. 10C is an embodiment of the locking tab with a tongue and groove configuration.

FIGS. 10A, 10B and 10C show three embodiments of the interface between the locking tab 22 and the holster body 12. FIG. 10A shows the locking tab 22 having a sloping surface; FIG. 10B shows a lap joint type interface; and FIG. 10C shows a tongue and groove type connection. Also shown in FIG. 10C is the insertion distance adjuster 72 and the adjustment screw 74.

From the foregoing description, it will be apparent that various changes may be made without departing from the spirit and scope of the invention as defined by the following claims. While there is shown and described the present preferred embodiment of the invention, it is to be distinctly understood that this invention is not limited thereto but may be variously embodied to practice within the scope of the following claims.

We claim:

1. A security holster for use with a semi-automatic handgun, of the type having a trigger guard and trigger, an ejection port, a barrel, a slide and a grip said holster comprising;

a holster body comprising a substantially rigid holster sidewall formed to define an inner cavity and an open upper portion for receiving said handgun therein and for removing said handgun therefrom, said holster body further comprising a barrel end opposite said open upper portion, and a long axis extending from said open upper portion toward said barrel end;

a locking tab attached to a lever, with said lever pivotably attached to said holster body at a fulcrum, configured to admit said semi-automatic handgun into said holster body, and upon insertion of said handgun into said holster body, with said locking tab configured to engage an ejection port feature of said semi-automatic handgun, thereby preventing the withdrawal of said handgun prior to release of said locking tab;

a release tab operationally connected to said locking tab, and configured to disengage said locking tab from said handgun ejection port feature so that when said release tab is pressed toward said inner cavity, said locking tab moves in an opposite direction, away from engagement with said ejection port feature;

a finger tube formed by a region between said handgun and said holster body, said finger tube with an axis generally parallel to said long axis of said holster body, and configured to cover said release tab, to restrict access to said release tab to a user's finger approaching said release tab from one direction only, in which a user inserts a finger in order to activate said release tab to release said locking tab from said handgun feature.

2. A holster with a protective finger tube comprising:

a holster body comprising substantially rigid opposing sidewalls formed to define an inner cavity and an open upper portion for receiving a handgun therein and for removing said handgun therefrom, said holster body further comprising a barrel end opposite said open upper portion, and a long axis extending from said open upper portion toward said barrel end, a top edge extending between said open portion and said barrel end, and a bottom edge opposite said top edge, with said top edge having an ejection port region, and said bottom edge having a trigger guard region;

a finger tube having a long axis attached to an exterior surface of said holster body with said tube long axis being substantially parallel with said holster long axis and designed to allow a finger to be inserted therein to access a release mechanism, said finger tube for controlling access to a locking mechanism of said security holster;

said locking mechanism adaptable to secure said handgun in said security holster by engagement with a feature of said handgun and by moving said locking mechanism in relation to said holster from a locked position to a released position;

a release mechanism surrounded by said finger tube for moving said locking mechanism of said security holster from a locking to a release position by movement of said locking mechanism to said release position; wherein said finger tube is configured to restrict or impede access to said release mechanism by anyone other than a wearer of said security holster.

3. The finger tube of claim 2, wherein the finger tube is configured so that said release mechanism may be operated by a user's index finger.

4. The finger tube of claim 2, wherein said locking mechanism is positioned in proximity to an ejection port region of said holster and is configured to interact with any of an ejection port of a semi-automatic handgun, a trigger guard of a revolver or semi-automatic handgun, or a back of a slide of a semi-automatic handgun.

5. A security holster for securing a handgun, said security holster comprising:

a holster body for receiving said handgun, said holster body comprising substantially rigid opposing sidewalls formed to define an inner cavity and an open upper portion for receiving said handgun therein and for removing said handgun therefrom, said holster body further comprising a barrel end opposite said open upper portion, and a long axis extending from said open upper portion toward said barrel end, a top upper edge extending between said open upper portion and said barrel end, and a bottom edge opposite said top edge, with said top edge having an ejection port region, and said bottom edge having a trigger guard region;

a latching mechanism positioned in proximity to said ejection port region, adapted to engage said ejection port;

a rebounding device positioned within said holster body adjacent said barrel end of said holster body, for providing biasing resistance to insertion of said handgun into said holster body until a latching mechanism of said security holster engages a handgun ejection port during insertion of said handgun, and for providing biasing resistance to pressing said handgun into said holster body sufficient to allow release of said latching mechanism prior to removal of said handgun from said security holster;

a release tab attached to said latching mechanism, said release tab positioned in the trigger guard region of said holster;

said latching mechanism configured to prevent said handgun from being released from the security holster without first moving said latching mechanism from a locked position to a release position.

6. The security holster of claim 5, wherein the rebounding device further comprises an insertion rebound adjustment mechanism for adjusting both a necessary force that must be exerted against the handgun and an insertion distance which the handgun moves in a direction parallel to a long axis of the security holster when inserting said handgun against said rebounding device.

7. A security holster for use with a semiautomatic handgun, said handgun having a trigger guard, an ejection port, barrel, slide, and handle, wherein the holster comprises:

a holster body that includes an inner substantially rigid sidewall adjacent a wearer's body and an outer substantially rigid sidewall opposite said inner sidewall, said inner and outer sidewalls to define an inner cavity and an open upper portion for receiving a handgun therein, and for removing a handgun there from, said holster having a long axis parallel with said barrel of said handgun when secured in said holster body, said holster body comprising a top edge defined by that portion of said holster body where said inner and outer substantially rigid sidewalls join to complete said inner cavity adjacent a top portion of a handgun slide when said handgun is inserted in said holster, with an ejection port region adjacent to said top edge in a position corresponding to the position of the ejection of the port of said handgun when inserted into said holster a bottom edge opposite the top edge, with a trigger guard region adjacent to the bottom edge, the holster body further having a barrel end region adapted to receive the barrel of said handgun when inserted in said holster;

a locking tab adapted to engage said ejection port attached to a lever and to a release tab, with said locking tab on an opposite end of said lever from said release tab, with said locking tab positioned in the ejection port region of said inner cavity of said holster body adjacent the holster body top edge, and with a fulcrum between said release tab and said locking tab, with the fulcrum attached to said holster body, with said locking tab configured to move from a locked position to a release position, with said release position further away from the center of said inner cavity of said holster than said locking position, and with said locking tab configured for engagement with an inserted handgun in said ejection port region of said holster body, thereby preventing the withdrawal of said handgun prior to release and removal of said locking tab from said ejection port;

said release tab positioned in said trigger guard region of said substantially outer sidewall of said holster body and operationally connected to said locking tab by said lever, so that when said release tab is pressed toward the interior of said inner cavity, the locking tab moves in the opposite direction, away from said ejection port and lifted away from said ejection port, thus releasing said handgun for withdrawal from said holster; wherein said locking tab, which admits said handgun during insertion and which engages said ejection port for retention of said handgun, is disengaged by movement of said release tab to lift said locking tab away from said ejection port.

8. The security holster of claim 7 in which said locking tab is positioned in said ejection port region of said holster body, in said outer sidewall of said holster body.

9. A security holster for use with a semiautomatic handgun, said handgun having a trigger guard, an ejection port, barrel, slide, and grip, wherein the holster comprises:

a holster body that includes an inner substantially rigid sidewall that when worn by a user is adjacent said users body, and an outer substantially rigid sidewall opposite said inner sidewall, said outer and inner sidewalls joining at a top edge and spaced apart to define an inner cavity, and an open upper portion for receiving a handgun therein, and for removing a handgun there from, said holster having a long axis parallel with said barrel of said handgun when secured in said holster body, said top edge corresponding to a handgun top of slide region, and an ejection port region adjacent to said top edge, corresponding to the ejection port region of a handgun when inserted in said holster, with the holster body having a bottom edge opposite the top edge, and a trigger guard region adjacent to the bottom edge corresponding to the location of the trigger guard region of said handgun when inserted in said holster, the holster body further having a barrel end region corresponding to the barrel end region of said handgun when inserted in said holster;

an ejection port engaging locking tab attached to a lever and to a release tab, with said locking tab on an opposite end of said lever, of said release tab with said locking tab positioned in the ejection port region of said outer substantially rigid sidewall of said holster body adjacent the holster body top edge, and with a fulcrum between said release tab and said locking tab, with the fulcrum attached to said outer substantially rigid sidewall between said ejection port region and said trigger guard region, with said locking tab configured to move from a locked position to a release position, with said release position further located away from the interior of said inner cavity of said holster than said locking position, and with said locking tab configured for engagement with an ejection port of an inserted handgun, thereby preventing the withdrawal of said handgun prior to release and removal of said locking tab from said ejection port;

a release tab operationally connected to said locking tab by said lever, with said release tab positioned in said trigger guard region of said outer substantially rigid sidewall, so that when said release tab is pressed toward said inner cavity, the locking tab moves in the opposite direction, away from the interior of said inner cavity , for lifting said locking tab from engagement with said ejection port, thus releasing said handgun for withdrawal from said holster.

10. A security holster for use with a semiautomatic handgun, said handgun having a trigger guard, an ejection port, barrel, slide, and grip, wherein the holster comprises:

a holster body that includes an inner substantially rigid sidewall that, when worn by a user is adjacent said users body, and an outer substantially rigid sidewall opposite said inner sidewall, said inner and outer sidewalls joined at a top edge and a bottom edge, said inner and outer sidewalls being spaced apart to define an inner cavity and an open upper end for receiving a handgun therein, and for removing a handgun there from, a barrel end opposite said open upper end, said holster having a long axis between said open upper end and said barrel end, with said holster body further comprising an ejection port region adjacent said top edge, and trigger guard region adjacent said bottom edge;

a locking tab attached to a lever and to a release tab, with said locking tab and said release tab on opposing ends of said lever, with said locking tab positioned in the ejection port region of said holster body adjacent the holster body top edge, and with a fulcrum between said release tab and said locking tab, with the fulcrum attached to said substantially rigid outer sidewall of said holster body, with said locking tab configured to move from a locked position to a release position, with said release position being further away from the interior of said inner cavity of said holster than said locking position, and with said locking tab configured for engagement with an ejection port of said handgun when inserted into said holster and in the ejection port region of said holster body, for preventing the withdrawal of said handgun prior to release and moving of said locking tab from said locked position to said release position;

a release tab positioned in the trigger guard region of said holster and operationally connected to said locking tab by said lever, so that when said release tab is pressed toward the interior of the inner cavity defined by the substantially rigid inner and outer sidewalls, the locking tab moves in the opposite direction, away from the interior of said inner cavity, for lifting said locking tab away from said locked position to said release position.

* * * * *